US010847086B2

(12) United States Patent
Kwon et al.

(10) Patent No.: US 10,847,086 B2
(45) Date of Patent: Nov. 24, 2020

(54) ORGANIC LIGHT-EMITTING DIODE DISPLAY DEVICE

(71) Applicant: LG Display Co., Ltd., Seoul (KR)

(72) Inventors: Yong-Chul Kwon, Seoul (KR); Jang-Hwan Kim, Paju-si (KR); Dong-Won Park, Goyang-si (KR); Jong-Min Park, Anyang-si (KR); Joon-Hee Lee, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/787,670

(22) Filed: Oct. 18, 2017

(65) Prior Publication Data

US 2018/0190192 A1 Jul. 5, 2018

(30) Foreign Application Priority Data

Dec. 30, 2016 (KR) ..... 10-2016-0184071

(51) Int. Cl.
*G09G 3/3233* (2016.01)
*G09G 3/3275* (2016.01)
*G09G 3/3266* (2016.01)

(52) U.S. Cl.
CPC ..... *G09G 3/3233* (2013.01); *G09G 3/3266* (2013.01); *G09G 3/3275* (2013.01);
(Continued)

(58) Field of Classification Search
CPC ..... G09G 2310/248; G09G 2310/0251; G09G 2320/0295; G09G 3/3275;
(Continued)

(56) References Cited

U.S. PATENT DOCUMENTS 7,755,578 B2 7/2010 Park et al.
8,558,825 B2 10/2013 Bae et al.
(Continued)

FOREIGN PATENT DOCUMENTS

CN 1975847 A 6/2007
CN 101116129 A 1/2008
(Continued)

OTHER PUBLICATIONS

Chaniotakis and Cory, Operational Amplifiers, 6.071, Spring 2006 (Year: 2006).*
(Continued)

*Primary Examiner* — Patrick N Edouard
*Assistant Examiner* — Douglas M Wilson
(74) *Attorney, Agent, or Firm* — Fenwick & West LLP

(57) ABSTRACT

An OLED display device capable of simplifying the configuration of an external compensation circuit and reducing a compensation time is disclosed. The OLED display device includes a display panel including a pixel, a feedback compensator circuit connected to the pixel through a data line and a sensing line of the display panel, the feedback compensator circuit including an error amplifier configured to receive, through a feedback line, a feedback current flowing into the sensing line and a feedback voltage generated by a sensing resistor, from the pixel during a scan period, compare a data input voltage with the feedback voltage to adjust a data output voltage supplied to the pixel through the data line, and set a target current for driving an OLED element in the pixel, and a precharger configured to precharge the feedback compensator circuit at a front part of the scan period.

19 Claims, 12 Drawing Sheets

(52) U.S. Cl.
CPC ..... *G09G 2300/0861* (2013.01); *G09G 2310/0248* (2013.01); *G09G 2310/0251* (2013.01); *G09G 2310/0262* (2013.01); *G09G 2310/0291* (2013.01); *G09G 2310/0297* (2013.01); *G09G 2310/08* (2013.01); *G09G 2320/0233* (2013.01); *G09G 2320/0252* (2013.01); *G09G 2320/0295* (2013.01); *G09G 2320/043* (2013.01); *G09G 2320/0693* (2013.01); *G09G 2330/021* (2013.01); *G09G 2330/028* (2013.01); *G09G 2330/08* (2013.01)

(58) Field of Classification Search
CPC ..... G09G 2320/0233; G09G 2320/043; G09G 2310/0297; G09G 2310/0291; G09G 3/3233
See application file for complete search history.

(56) References Cited

U.S. PATENT DOCUMENTS

| | | | | |
|---|---|---|---|---|
| 9,111,489 | B2 | 8/2015 | Park et al. | |
| 9,202,411 | B2 | 12/2015 | Jung et al. | |
| 9,940,878 | B2 | 4/2018 | Liang | |
| 9,966,002 | B2 | 5/2018 | Xiang et al. | |
| 10,032,409 | B1 | 7/2018 | Wu | |
| 10,089,934 | B2 | 10/2018 | Nam et al. | |
| 10,529,278 | B2 | 1/2020 | Wu | |
| 2003/0030603 | A1 | 2/2003 | Shimoda | |
| 2006/0232522 | A1 | 10/2006 | Roy et al. | |
| 2007/0008253 | A1 | 1/2007 | Nathan et al. | |
| 2007/0120780 | A1 | 5/2007 | Park et al. | |
| 2009/0140959 | A1 | 6/2009 | Nam et al. | |
| 2009/0213049 | A1* | 8/2009 | McCreary | G09G 3/3291 345/80 |
| 2010/0301762 | A1* | 12/2010 | Kung | G09G 3/3406 315/193 |
| 2011/0122119 | A1 | 5/2011 | Bae et al. | |
| 2011/0205206 | A1 | 8/2011 | Yoo et al. | |
| 2014/0176400 | A1 | 6/2014 | Park et al. | |
| 2014/0176622 | A1 | 6/2014 | Jung et al. | |
| 2014/0347253 | A1 | 11/2014 | Lee | |
| 2017/0061871 | A1* | 3/2017 | Xiang | G09G 3/3233 |
| 2017/0103703 | A1* | 4/2017 | Bi | G09G 3/3291 |
| 2017/0162125 | A1 | 6/2017 | Liang | |
| 2018/0197468 | A1 | 7/2018 | Wu | |
| 2018/0301084 | A1 | 10/2018 | Wu | |

FOREIGN PATENT DOCUMENTS

| | | | |
|---|---|---|---|
| CN | 101430862 | A | 5/2009 |
| CN | 102074189 | A | 5/2011 |
| CN | 102768821 | A | 11/2012 |
| CN | 103903559 | A | 7/2014 |
| CN | 103903582 | A | 7/2014 |
| CN | 104183212 | A | 12/2014 |
| CN | 105047137 | A | 11/2015 |
| CN | 105702206 | A | 6/2016 |
| CN | 106057130 | A | 10/2016 |
| CN | 106097969 | A | 11/2016 |

OTHER PUBLICATIONS

China National Intellectual Property Administration, First Notification of Office Action, CN Patent Application No. 201711057442.X, dated Apr. 23, 2020, 16 pages.

China National Intellectual Property Administration, Office Action, CN Patent Application No. 201711057442.X, dated Sep. 8, 2020, 15 pages.

* cited by examiner

ORGANIC LIGHT-EMITTING DIODE DISPLAY DEVICE

CROSS-REFERENCE TO RELATED APPLICATIONS

This application claims the benefit of Republic of Korea Patent Application No. 10-2016-0184071, filed on Dec. 30, 2016, which is hereby incorporated by reference in its entirety.

BACKGROUND OF THE INVENTION

Field of the Invention

The present invention relates to an organic light-emitting diode (LED) display device for simplifying the configuration of an external compensation circuit and reducing a compensation time.

Discussion of the Related Art

A representative flat panel display device for displaying images using digital data includes a liquid crystal display (LCD) using liquid crystal, an organic light-emitting diode (OLED) display device using OLEDs, and an electrophoretic display (EPD) using electrophoretic particles.

Thereamong, the OLED display device is a self-luminescent device which causes an organic light-emitting layer to emit light through recombination of electrons and holes and is expected as a next-generation display device thanks to high luminance, low driving voltage, and ultra-thin film thickness.

Each of a plurality of pixels constituting the OLED display device includes an OLED element and a pixel circuit for driving the OLED element. The pixel circuit includes a switching thin film transistor (TFT) for transferring a data voltage to a storage capacitor and a driving TFT for controlling current according to a voltage charged in the storage capacitor to supply the current to the OLED element. The OLED element generates light in proportion to a current value.

The OLED display device is nonuniform in a threshold voltage of a driving TFT per pixel and driving characteristics of the driving TFT according to process deviation, driving environment, and driving time and differs in driving current with respect to the same voltage, so that a nonuniform luminance phenomenon may occur. To solve this problem, the OLED display device additionally performs an external compensation operation for sensing driving characteristics of each driving TFT and compensating for the sensed result.

For example, the OLED display device performs the external compensation operation in a manufacturing process and a real-time driving process to sense the driving characteristics of each driving TFT, determine compensation values for compensating for a characteristic deviation of the driving TFT based on sensing information, and store the compensation values in a memory. The OLED display device compensates for data which is to be supplied to each subpixel using the compensation values stored in the memory and drives each subpixel using the compensated data.

However, the OLED display device having a conventional external compensation function requires an additional panel sensing time for the external compensation operation at a power-ON/OFF time during the manufacturing process and real-time driving and additionally requires a sensing circuit and an operation circuit for acquiring the compensation values and the memory for storing the compensation values, thereby causing time loss and increasing cost of circuit components.

Accordingly, the conventional OLED device needs to simplify an external compensation circuit and reduce a compensation time.

SUMMARY OF THE INVENTION

Accordingly, the present invention is directed to an OLED display device that substantially obviates one or more problems due to limitations and disadvantages of the related art.

An object of the present invention is to provide an OLED display device capable of simplifying the configuration of an external compensation circuit and reducing a compensation time.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an OLED display device includes a display panel including a pixel, a feedback compensator circuit, and a precharger circuit. The feedback compensator circuit is connected to the pixel through a data line and a sensing line of the display panel. The feedback compensator circuit includes a sensing resistor and an error amplifier. The sensing resistor is configured to generate a feedback voltage on a feedback line based on a feedback current flowing through the sensing line during a scan period. The error amplifier is configured to receive the feedback voltage from the feedback line and a data input voltage from an input line, to compare the data input voltage with the feedback voltage to generate a data output voltage based on a difference between the data input voltage and the feedback voltage, and to supply the data output voltage to the pixel through the data line. The data output voltage sets a target current for driving an OLED element in the pixel. The precharger circuit is configured to cause the data line to precharge during a precharge period at an initial portion of the scan period.

The pixel may include a driving TFT configured to drive the OLED element, a first switching TFT controlled by a first gate line and configured to connect the data line to a gate electrode of the driving TFT during the scan period, a second switching TFT controlled by a second gate line and configured to connect the sensing line to a source electrode of the driving TFT during the scan period, and a capacitor connected between the gate electrode and the source electrode of the driving TFT and configured to store a driving voltage of the driving TFT determined by the target current set during the scan period and maintain the driving voltage during a light-emitting period following the scan period.

The precharger circuit may include a precharge switch and an amplifier. The precharge switch is connected between a first input terminal of the error amplifier and a second input terminal of the error amplifier. The first input terminal may be connected to the input line for supplying the data input voltage and the second input terminal being connected to the feedback line. The amplifier is configured to compare the data input voltage with the feedback voltage to control the precharge switch to turn on when the data input voltage has greater than a threshold difference from the feedback voltage. The precharger circuit precharges the feedback line to the data input voltage during the precharge period when the precharge switch is on.

In another embodiment, the precharger circuit may include a precharge switch configured to couple the feedback line to a precharge voltage supplied from a power source in response to a precharge control signal during the precharge period. The precharge voltage may be predetermined by the power source or may be controlled by the power source according to a degradation estimation value calculated by accumulating image data displayed on the display panel.

In another embodiment, the precharger circuit may include a precharge switch configured to couple the feedback line to the data input voltage in response to a precharge control signal during the precharge period to precharge the feedback line to the data input voltage.

The OLED display device may further include a scan driver, a data driver, and a timing controller. The scan driver is configured to drive a gate line of the display panel. The data driver includes the feedback compensator circuit and an output buffer. The timing controller is configured to control driving timings of the scan driver and the data driver. The timing controller controls timing of a first scan period during which the feedback compensator circuit generates the data voltage and a second scan period during which the output buffer generates the data output voltage by buffering the data input voltage. The second scan period may be shorter than the first scan period. The timing controller may control the scan driver and the data driver such that pixels within a same row as the pixel use respective feedback compensation circuits to generate respective data output voltages during the first scan period and the pixels outside the same row as the pixel use respective output buffers to generate respective data output voltages during the first scan period of the pixel.

During the first scan period, the data driver may convert image data supplied from the timing controller into the data input voltage, output the data output voltage controlled by the feedback compensator circuit to the data line, sense the data output voltage output to the data line, convert the sensed data output voltage into digital data, and supply the digital data to the timing controller as sensing data. The timing controller may compare the image data supplied to the data driver with the sensing data sensed by the data driver to determine a difference. The timing controller may then calculate a compensation value for compensating for a characteristic deviation of the pixel based on the difference, and store the calculated compensation value in a memory.

During the second scan period, the data driver may convert the image data supplied from the timing controller into the data input voltage, buffer the data input voltage through the output buffer, and output the buffered data input voltage as the data output voltage. The timing controller may adjust input image data using the compensation value stored in the memory and output the compensated image data to the data driver.

In another embodiment, an organic light-emitting diode (OLED) display device comprises a display panel, a data driver, and a timing controller. The display panel includes a pixel. The data driver drives a data line of the pixel and receive a feedback voltage from a feedback line of the pixel. The data driver includes an error amplifier, an output buffer, and a multiplexer. The error amplifier is configured to receive a feedback voltage from the feedback line and a data input voltage from an input line and to compare the data input voltage with the feedback voltage to generate a first data output voltage based on a difference between the data input voltage and the feedback voltage. The output buffer is configured to receive the data input voltage and to buffer the data input voltage to generate a second data output voltage. The multiplexer is configured to select between providing the first data output voltage and the second data output voltage to a data line of a corresponding pixel. The timing controller is configured to control the multiplexer to select the first data output voltage for providing to the data line during a first scan period and to select the second data output voltage for providing to the data line during a second scan period.

In an embodiment, the timing controller selects the first data output voltage during every N scan periods of the pixel (where N is a number of pixel rows in the display panel) and selects the second data output voltage during remaining scan periods of the pixel.

In an embodiment, a sensing resistor generates the feedback voltage on a feedback line based on a feedback current flowing through the sensing line during the first scan period. A precharger circuit causes the data line to precharge during a precharge period at an initial portion of the first scan period.

In an embodiment, the precharger circuit includes a precharge switch and an amplifier. The precharge switch is connected between a first input terminal of the error amplifier and a second input terminal of the error amplifier. The first input terminal is connected to the input line for supplying the data input voltage and the second input terminal is connected to the feedback line. The amplifier is configured to compare the data input voltage with the feedback voltage to control the precharge switch to turn on when the data input voltage has greater than a threshold difference from the feedback voltage. The precharger circuit precharges the feedback line to the data input voltage during the precharge period when the precharge switch is on.

In an embodiment, the precharger circuit includes a precharge switch configured to couple the feedback line to a precharge voltage supplied from a power source in response to a precharge control signal during the precharge period. The precharge voltage is based on a degradation estimation value calculated by accumulating image data displayed on the display panel.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Figure 1:
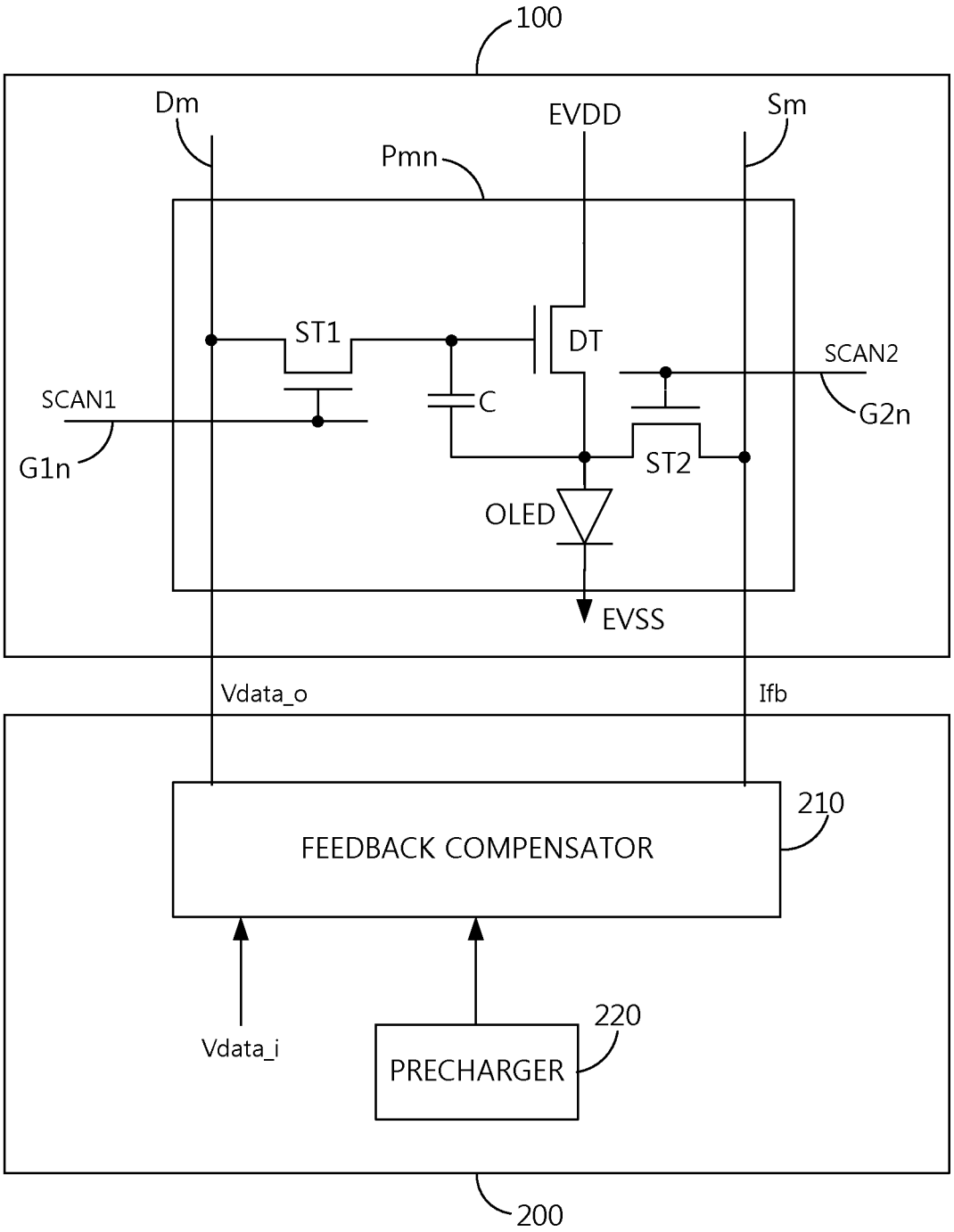
FIG. 1 is a circuit diagram illustrating a partial configuration of an OLED display device according to an embodiment of the present invention.
Figure 2:
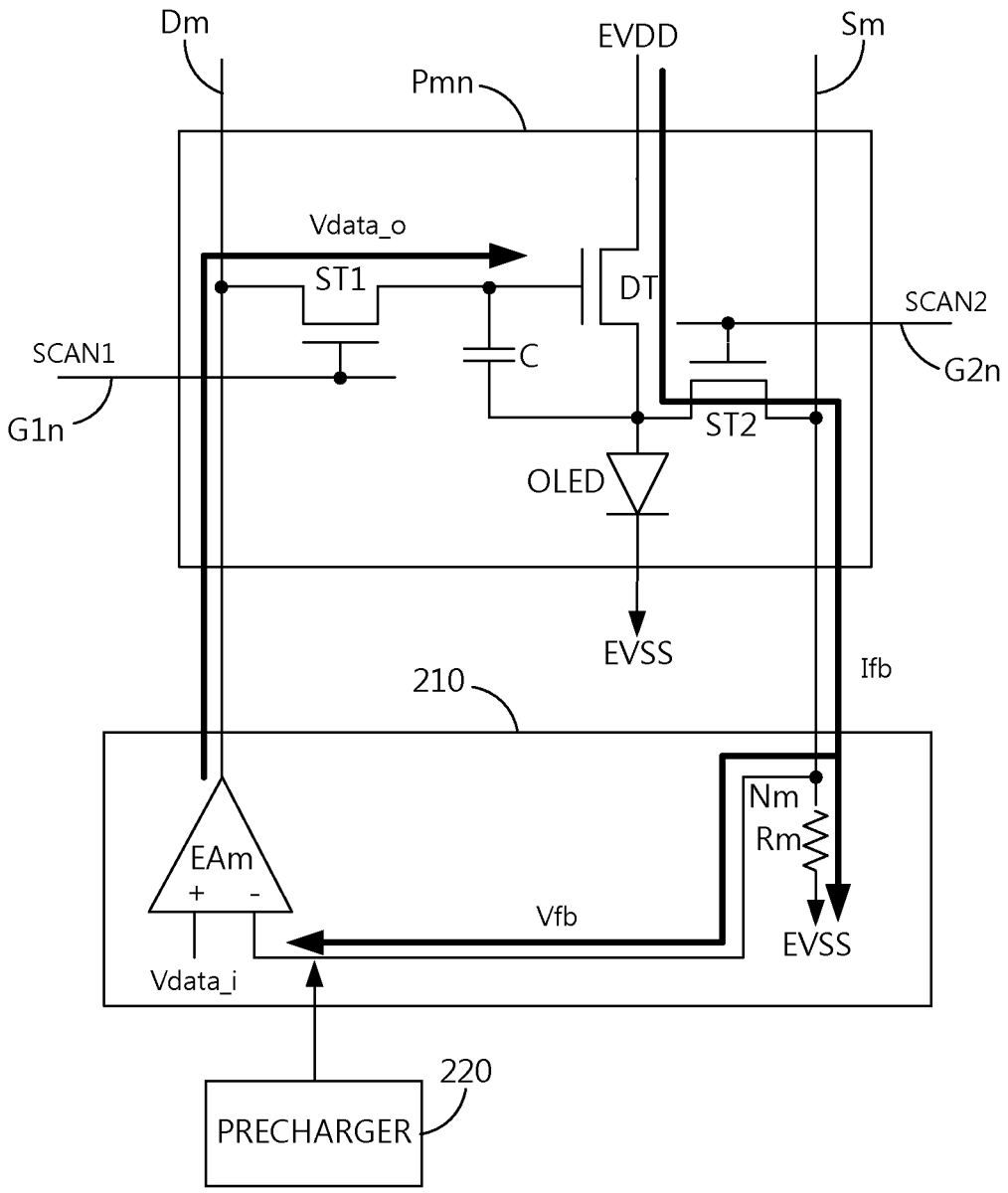
FIG. 2 is a diagram illustrating a feedback compensation principle of the OLED display device shown in FIG. 1.

FIG. 1 is a circuit diagram illustrating a partial configuration of an OLED display device according to an embodiment of the present invention and FIG. 2 is a diagram illustrating an operation of a pixel shown in FIG. 1.

Referring to FIG. 1, the OLED display device according to an embodiment includes a display panel 100 and a data driver 200. The display panel 100 representatively shows an (m, n)-th pixel Pmn located in an m-th (where m is a natural number) pixel column and an n-th (where n is a natural number) pixel row, among a plurality of pixels configured in the form of a matrix. The data driver 200 representatively shows an m-th feedback compensator circuit 210 connected as a feedback structure to an m-th sensing line Sm to drive an m-th data line Dm and a precharger 220 for precharging a feedback line of the feedback compensator circuit 210.

The pixel Pmn includes an OLED element, a driving TFT DT, a first switching TFT ST1, a second switching TFT ST2, and a capacitor C. The switching TFTs ST1 and ST2 and the driving TFT DT may use amorphous silicon (a-Si) TFTs, polycrystalline silicon (poly-Si) TFTs, oxide TFTs, or organic TFTs.

The driving TFT DT is connected between a first power (hereinafter, EVDD) line and an anode of the OLED element to supply a driving current to the OLED element by controlling the amount of current supplied from the EVDD line.

The capacitor C connected between a gate electrode and a source electrode of the driving TFT DT stores a target driving voltage Vgs for maintaining the driving current flowing into the OLED element via the driving TFT DT.

The OLED element includes an anode connected to the source electrode of the driving TFT DT, a cathode connected to a second power (hereinafter, EVSS) line, and an organic light-emitting layer connected between the anode and the cathode. Although the anode is independently formed with respect to each pixel, the cathode may be commonly shared by all pixels. If the driving current is supplied from the driving TFT DT to the OLED element, electrons and holes are respectively injected from the cathode and the anode of the OLED element into the organic light-emitting layer and recombine in the organic light-emitting layer to emit fluorescent or phosphorescent materials, thereby generating light having brightness proportional to a current value of the driving current.

The first switching TFT ST1 is controlled by a scan signal SCAN1 of a first gate line G1*n* of the n-th pixel row to connect the data line Dm of the m-th pixel column to the gate electrode of the driving TFT DT during a scan period of the n-th pixel row. The second switching TFT ST2 is controlled by a scan signal SCAN2 of a second gate line G2*n* of the n-th pixel row to connect the source electrode of the driving TFT DT to the sensing line Sm of the m-th pixel column during the scan period of the n-th pixel row.

Meanwhile, the first and second gate lines G1*n* and G2*n* may be incorporated into one gate line Gn. That is, the first and second switching TFTs ST1 and ST2 may be controlled by the same scan signal supplied from one gate line Gn during the scan period of the n-th pixel row.

The feedback compensator circuit 210 includes, as illustrated in FIG. 2, a sensing resistor Rm connected between the sensing line Sm and the EVSS line and an error amplifier EAm having a non-inverting terminal + to which a data input voltage Vdata_i is supplied, an inverting terminal − connected to a feedback line which is connected to a sensing node Nm between the sensing line Sm and the sensing resistor Rm, and an output terminal connected to the data line Dm.

The data driver 200 converts digital pixel data into an analog data input voltage Vdata_i to supply the analog data input voltage Vdata_i to the feedback compensator circuit 210.

During the scan period, the error amplifier EAm compares the data input voltage Vdata_i with a feedback voltage Vfb which is determined according to a current Ifb of the pixel Pmn flowing through the sensing resistor Rm to adjust and set a data output voltage Vdata_o so that the feedback voltage Vfb converges on the data input voltage Vdata_i. As such, the error amplifier EAm sets the data output voltage Vdata_o according to the feedback voltage Vfb in which driving characteristics (a threshold voltage and mobility) of the driving TFT DT are reflected and supplies the set data output voltage Vdata_o to each pixel Pmn. Therefore, the error amplifier EAm may set a constant target current of the driving TFT DT matching the data input voltage Vdata_i regardless of deviation of the driving characteristics (the threshold voltage and mobility) of the driving TFT DT.

Specifically, referring to FIG. 2, during the scan period of the pixel Pmn, the error amplifier EAm supplies the data output voltage Vdata_o matching the data input voltage Vdata_i through the data line Dm and the first switching TFT ST1 to drive the driving TFT DT, receives a feedback voltage Vfb from the feedback line based on the current Ifb flowing into the sensing line Sm through the second switching TFT ST2 from the driving TFT DT. The feedback voltage Vfb is generated at a sensing node Nm in proportion to a sensing resistance R. The error amplifier Eam compares the feedback voltage Vfb with the data input voltage Vdata_i to check whether the current Ifb flowing into the driving TFT DT matches the data input voltage Vdata_i and generates a data output voltage Vdata_o based on a difference between the data input voltage Vdata_i and the feedback voltage Vfb. The error amplifier EAm adjusts and sets the data output voltage Vdata_o so that the feedback voltage Vfb converges on the data input voltage Vdata_i.

For example, if the feedback voltage Vfb is less than the data input voltage Vdata_i, the error amplifier EAm increases the data output voltage Vdata_o to increase the amount of the current of the driving TFT DT. If the feedback voltage Vfb is greater than the data input voltage Vdata_i, the error amplifier EAm decreases the data output voltage Vdata_o to reduce the amount of the current of the driving TFT DT. Thus, the error amplifier EAm sets a target current of the driving TFT DT matching the data input voltage Vdata_i.

The capacitor C stores the driving voltage Vgs determined by the target current of the driving TFT DT during the scan period and maintains the driving voltage Vgs during a light-emitting period, thereby causing the OLED element to emit light by the constant target current of the driving TFT DT with respect to the data input voltage Vdata_i.

During the scan period, an OFF voltage lower than a threshold voltage of the OLED element is applied to the anode of the OLED element so that the OLED element is turned off. If the amount of current is adjusted by properly setting design values of the error amplifier EAm and the sensing resistor Rm, the OFF voltage may be supplied to the anode of the OLED element during the scan period.

However, in a voltage feedback scheme according to an embodiment, since a charging speed of the feedback line is slow, it may be difficult to charge the feedback line in a sufficient amount of time for the scan period.

To prevent this problem, an OLED display device according to an embodiment shortens a charging time of the feedback line by causing the data line to precharge during a precharge period an an initial portion of the scan period. For example, the precharger 220 may precharge the feedback line or the output terminal of the error amplifier EAm during the precharge period at an initial portion of the scan period, thereby securing the scan period.

Hereinafter, various embodiments of the precharger 220 will be described with reference to FIGS. 3 to 7.

Figure 3:
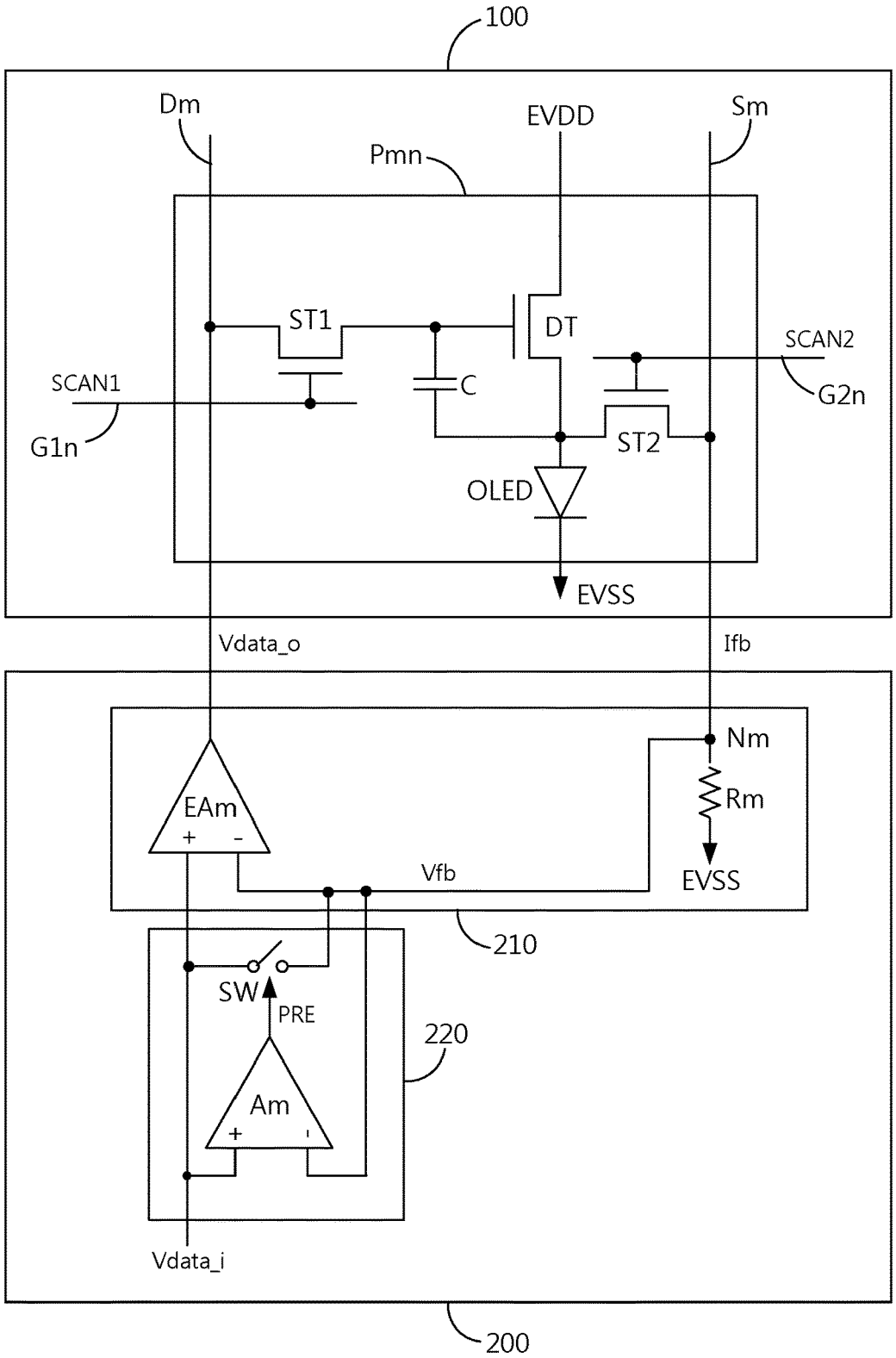
FIG. 3 is a circuit diagram illustrating a partial configuration of an OLED display device according to an embodiment of the present invention.
Figure 4:
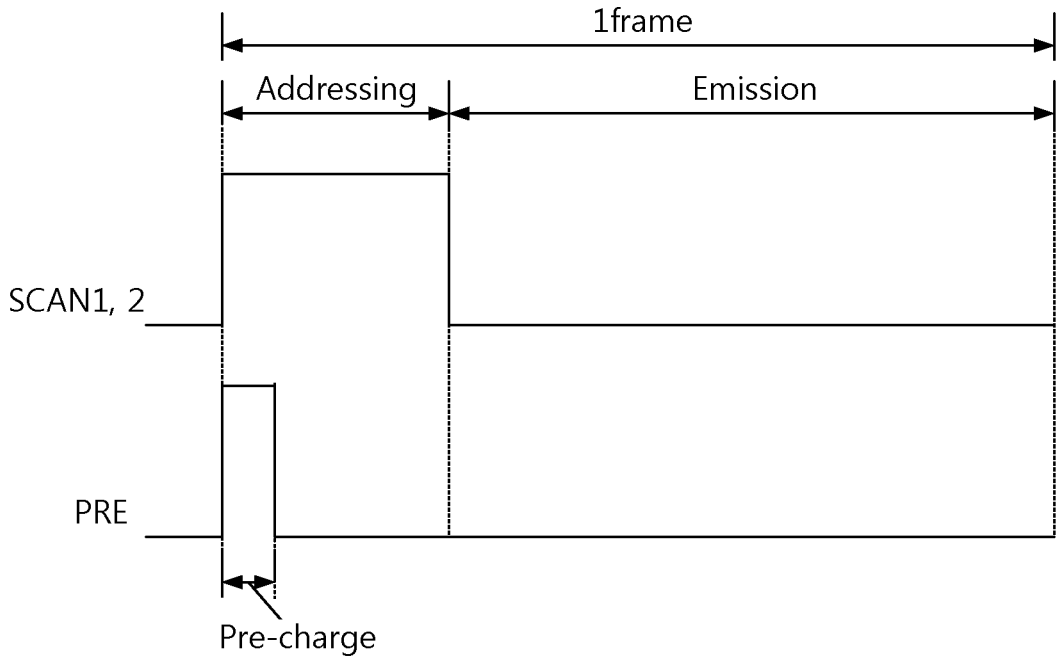
FIG. 4 is a waveform chart of the OLED display device shown in FIG. 3.
Figure 5:
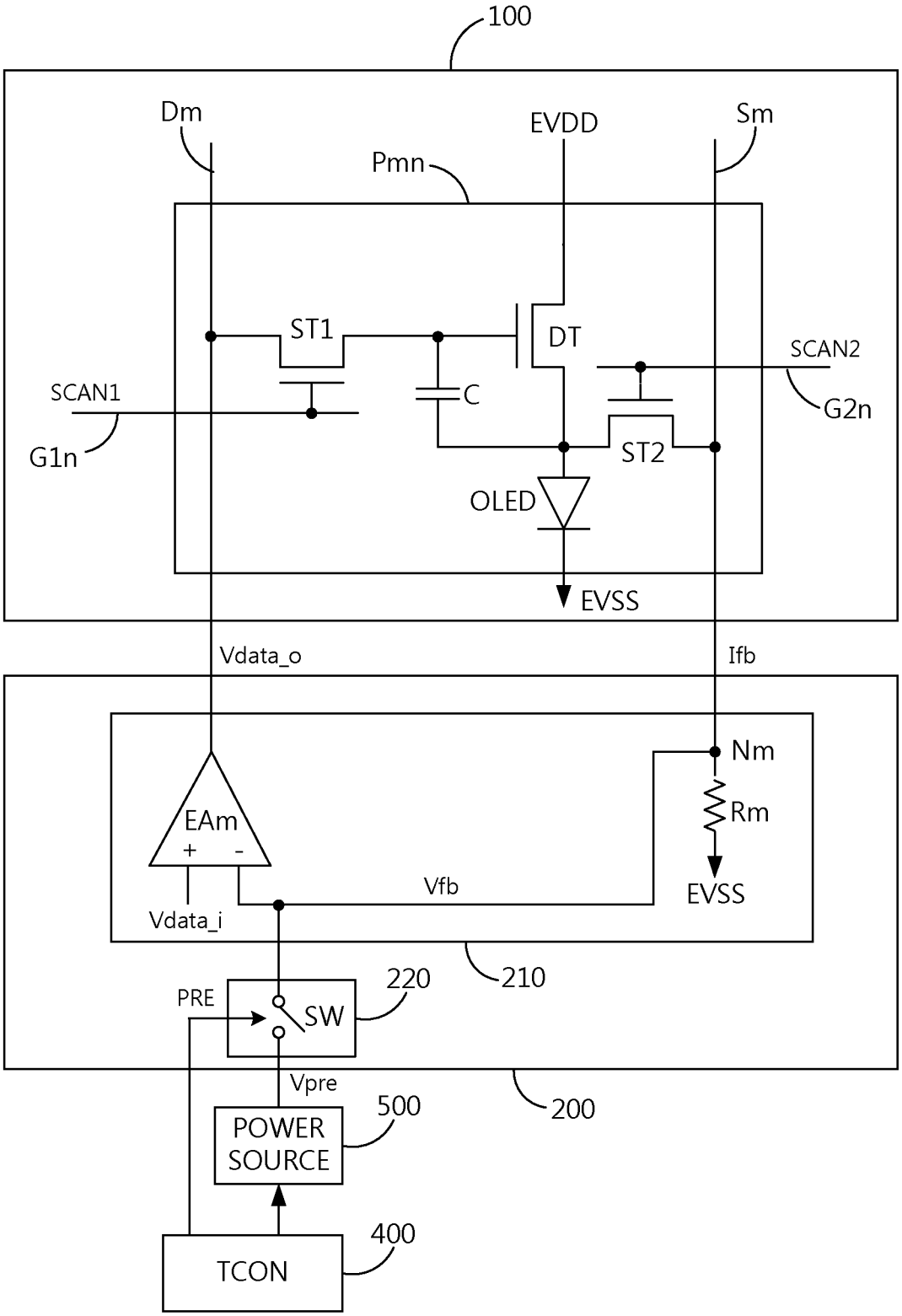
FIG. 5 is a circuit diagram illustrating a partial configuration of an OLED display device according to an embodiment of the present invention.
Figure 6:
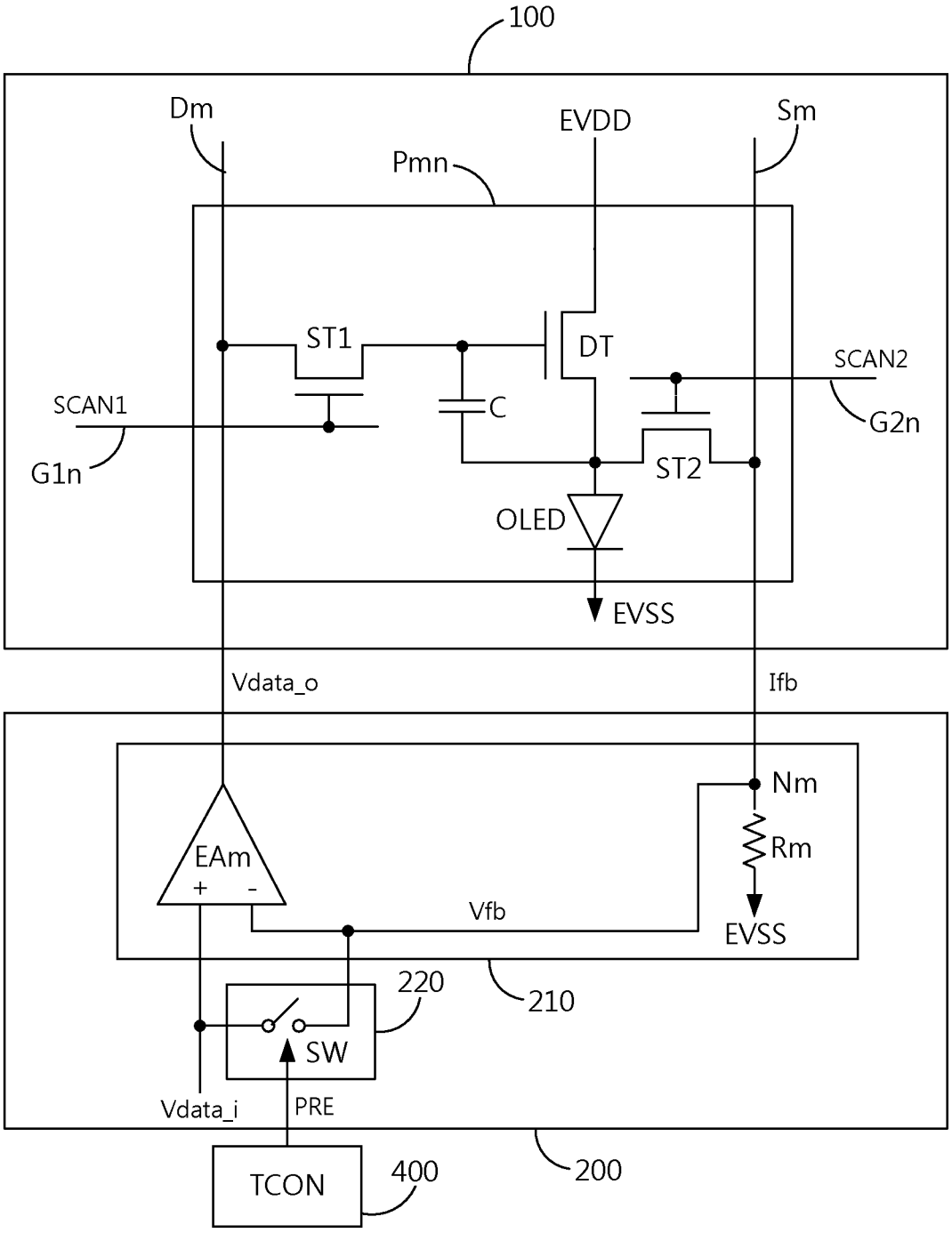
FIG. 6 is a circuit diagram illustrating a partial configuration of an OLED display device according to an embodiment of the present invention.

FIGS. 3, 5, and 6 illustrate various embodiments of the precharger 220 of the OLED display device according to the present invention and FIG. 4 is a driving waveform chart for controlling a scan period and a precharging period according to the present invention.

Referring to FIG. 3, the precharger 220 includes a precharge switch SW for precharging the feedback line to the data input voltage Vdata_i by shorting the input terminals + and − of the error amplifier EAm and an amplifier Am for controlling the precharge switch SW by comparing the data input voltage Vdata_i with the feedback voltage Vfb of the feedback line.

The amplifier Am compares the data input voltage Vdata_i with the feedback voltage Vfb. If there is a big difference between the feedback voltage Vfb and the data input voltage Vdata_i (e.g., greater than a threshold difference), the amplifier Am generates an ON signal as a precharge control signal PRE to turn on the precharge switch SW. If the feedback voltage Vfb is similar to the data input voltage Vdata_i, the amplifier Am generates an OFF signal as the precharge control signal PRE to turn off the precharge switch SW.

Referring to FIG. 4, the precharge switch SW is turned on by the precharge control signal PRE supplied from the amplifier Am only during a front part in which there is a big difference between the data input voltage Vdata_i and the feedback voltage Vfb, out of the scan period (addressing period) determined by the scan signals SCAN1 and SCAN2 supplied to the pixel Pmn, thereby precharging the feedback line to the same voltage as the data input voltage Vdata_i. Thus, the charging time of the feedback line during the scan period can be remarkably reduced.

Next, during the scan period (addressing period), if the data input voltage Vdata_i becomes similar to the feedback voltage Vfb, the precharge switch SW is turned off by the precharged control signal PRE supplied from the amplifier Am. Then, the error amplifier EAm compares the data input voltage Vdata_i with the feedback voltage Vfb to adjust the data output voltage Vdata_o, thereby performing a feedback compensation operation for setting the target current of the driving TFT DT.

Referring to FIG. 5, the precharge switch SW may precharge the feedback line to a precharging voltage Vpre supplied from a power source 500 at a front part of a scan period in response to a precharge control signal PRE supplied from a timing controller (hereinafter, TCON) 400.

The precharge voltage Vpre supplied from the power source 500 may be similar to data input voltage Vdata_i or may be slightly less than the data input voltage Vdata_i.

Meanwhile, the precharge voltage Vpre supplied from the power source 500 may be adjusted according to a degradation estimation value of a display panel determined by the TCON 400. The TCON 400 may calculate the degradation estimation value by counting and accumulating image data supplied to the display panel and correct the image data supplied to the display panel using the degradation estimation value. As the degradation estimation value increases, the image data also increases. Therefore, the TCON 400 may control the power source 500 such that the precharging voltage Vpre increases according to the degradation estimation value. Then, since the precharging voltage Vpre is adjusted according to the data input voltage Vdata_i which is corrected using the degradation estimation value, the charging time of the feedback line can be further reduced.

Referring to FIG. 6, the precharge switch SW may precharge the feedback line to the data input voltage Vdata_i in response to the precharge control signal PRE supplied from the TCON 400. Thus, the charging time of the feedback line can be remarkably reduced.

Figure 7:
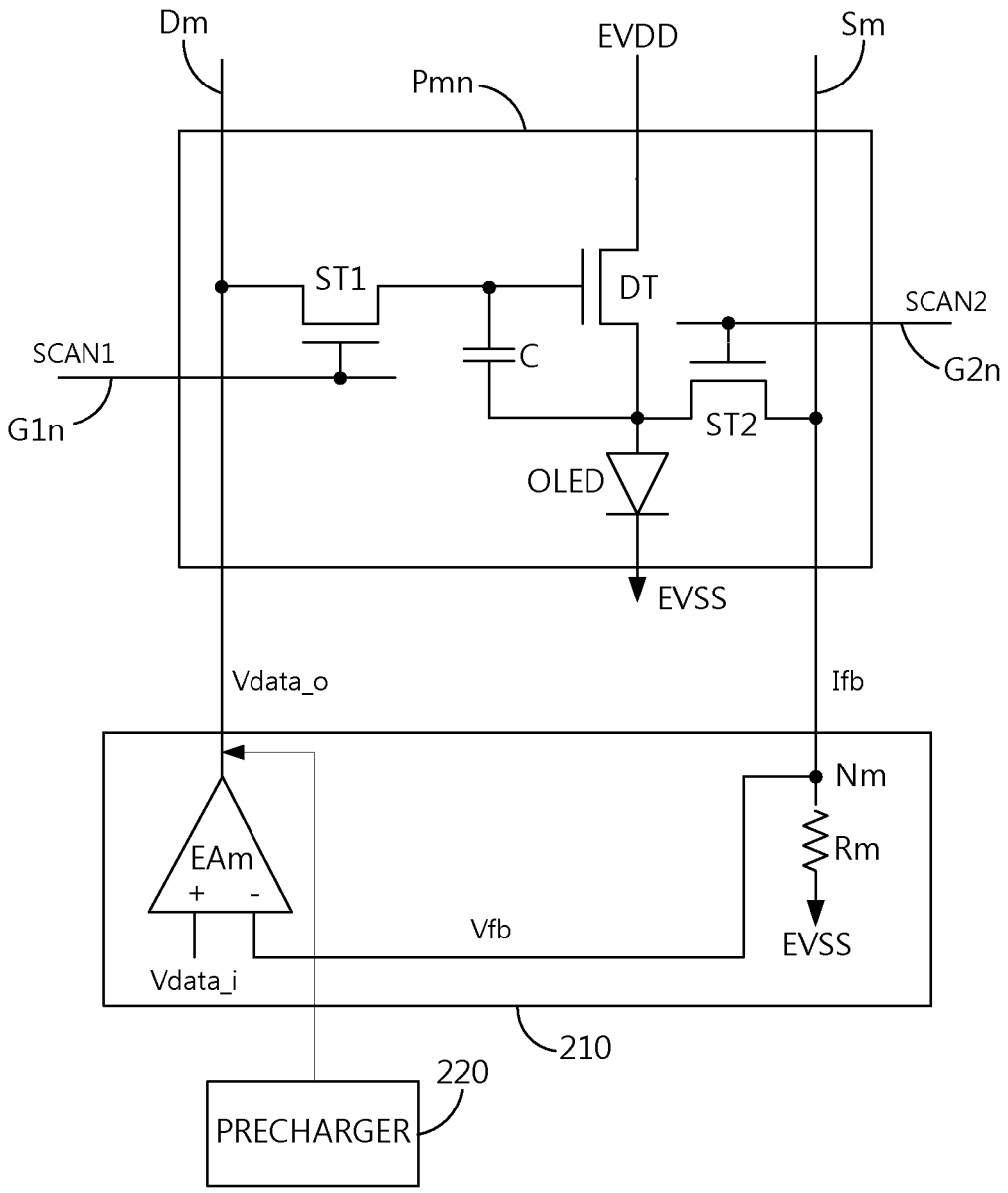
FIG. 7 is a circuit diagram illustrating a partial configuration of an OLED display device according to an embodiment of the present invention.

FIG. 7 is a circuit diagram illustrating a partial configuration of an OLED display device according to an embodiment of the present invention. As illustrated in FIG. 7, the precharger 220 according to an embodiment may precharge the output terminal of the error amplifier EAm connected to the data line Dm at a front part of the scan period. Even in this case, since the output current of the pixel Pmn increases through precharging of the data line Dm, the charging time of the sensing line (Sm) and the feedback line can be shortened. A detailed configuration of the precharger 220 according to the embodiments described with reference to FIGS. 3 to 6 and the method of driving the same may be equally applied to the precharger 220 shown in FIG. 7.

Thus, the OLED display device according to an embodiment corrects the data output voltage Vdata_o on a real-time basis by reflecting characteristics of the driving TFT DT based on a voltage feedback scheme during each scan period, thereby simplifying the configuration of an external compensation circuit and reducing the scan period of a voltage feedback compensation scheme through reduction of the charging time of the feedback line caused by precharging of the feedback compensator circuit. Meanwhile, even though the scan period of the voltage feedback compensation scheme is reduced through precharging, since the scan period of the voltage feedback compensation scheme is still greater than a normal scan period which does not use the voltage feedback compensation scheme, the scan period of the voltage feedback compensation scheme may be intermittently applied in each frame without being applied to all scan lines to thus further reduce the scan period of the entire panel.

Figure 8:
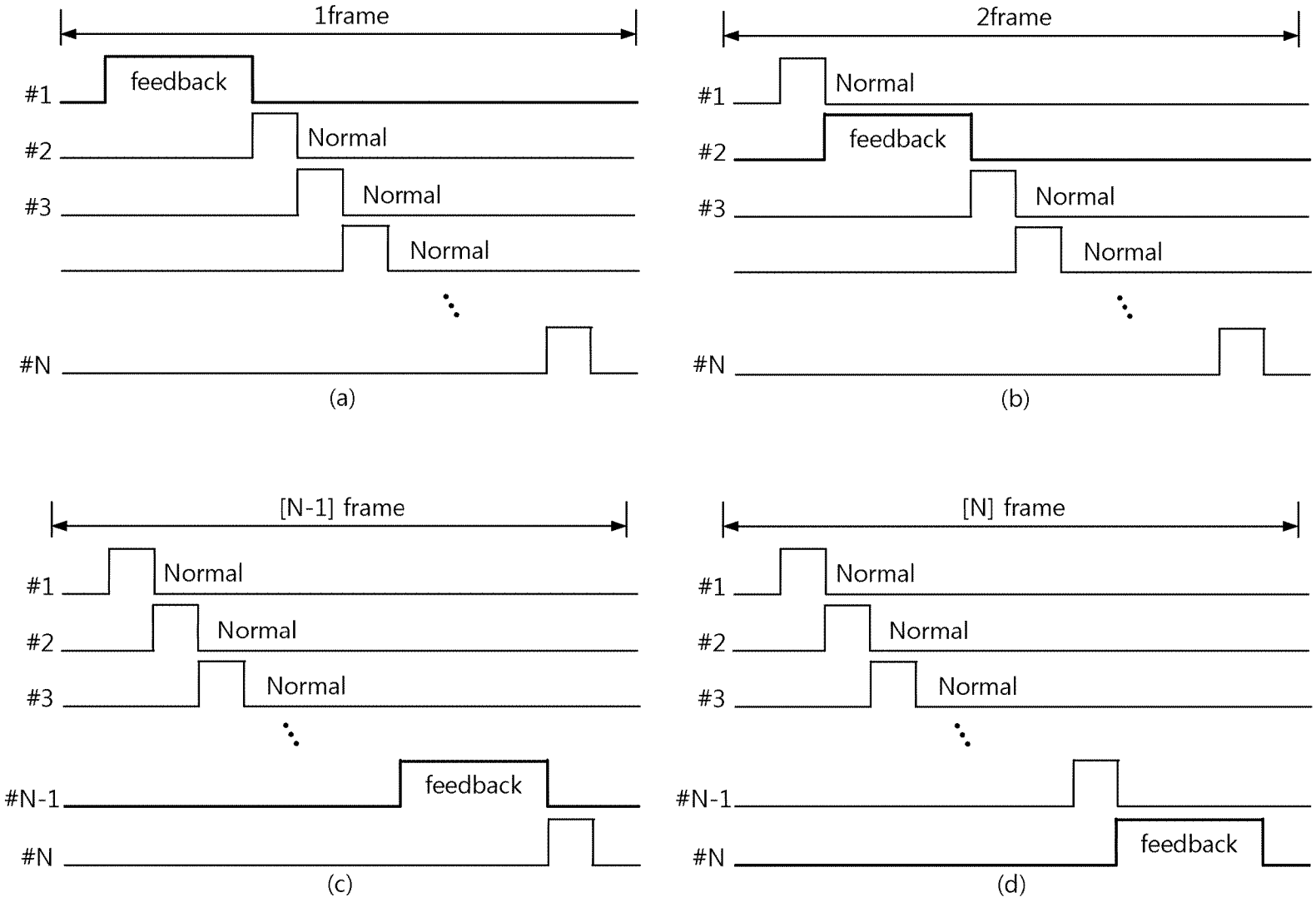
FIG. 8 is a driving waveform chart illustrating a scan method of an OLED display device according to an embodiment of the present invention.
Figure 9:
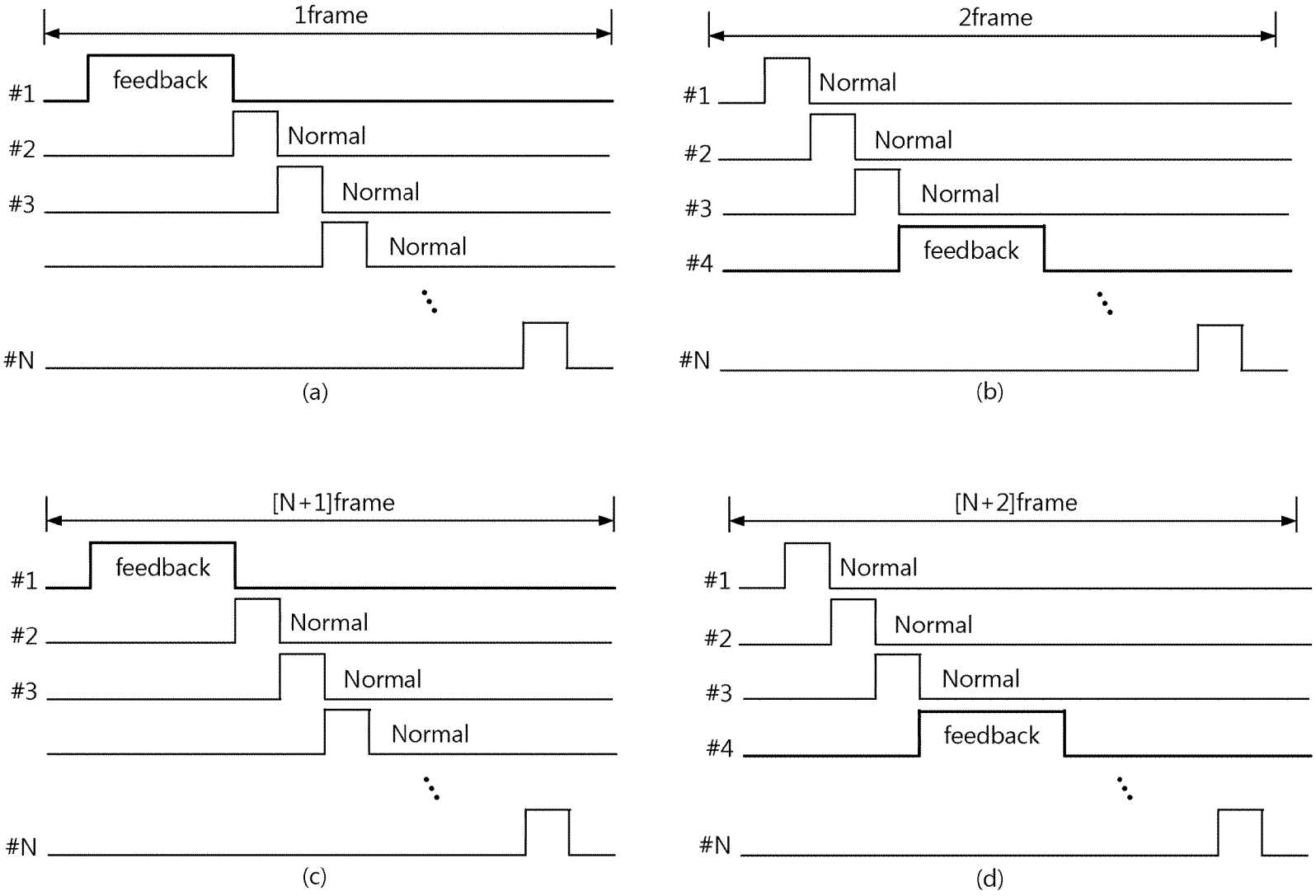
FIG. 9 is a driving waveform chart illustrating a scan method of an OLED display device according to another embodiment of the present invention.

FIG. 8 is a driving waveform chart illustrating a scan method of an OLED display device according to an embodiment of the present invention and FIG. 9 is a driving waveform chart illustrating a scan method of an OLED display device according to another embodiment of the present invention.

Referring to FIGS. 8 and 9, among N (where N is a natural number) scan lines, the scan period of the voltage feedback scheme described in the above embodiments is applied to only one scan line in each frame and the normal scan scheme which does not use the voltage feedback scheme is applied to the other scan lines. A scan line to which the scan period of the voltage feedback scheme is applied differs in every frame.

For example, the location of a scan line to which the scan period of the voltage feedback scheme is applied may be sequentially changed as illustrated in FIG. 8 or may be randomly changed as illustrated in FIG. 9.

Figure 10:
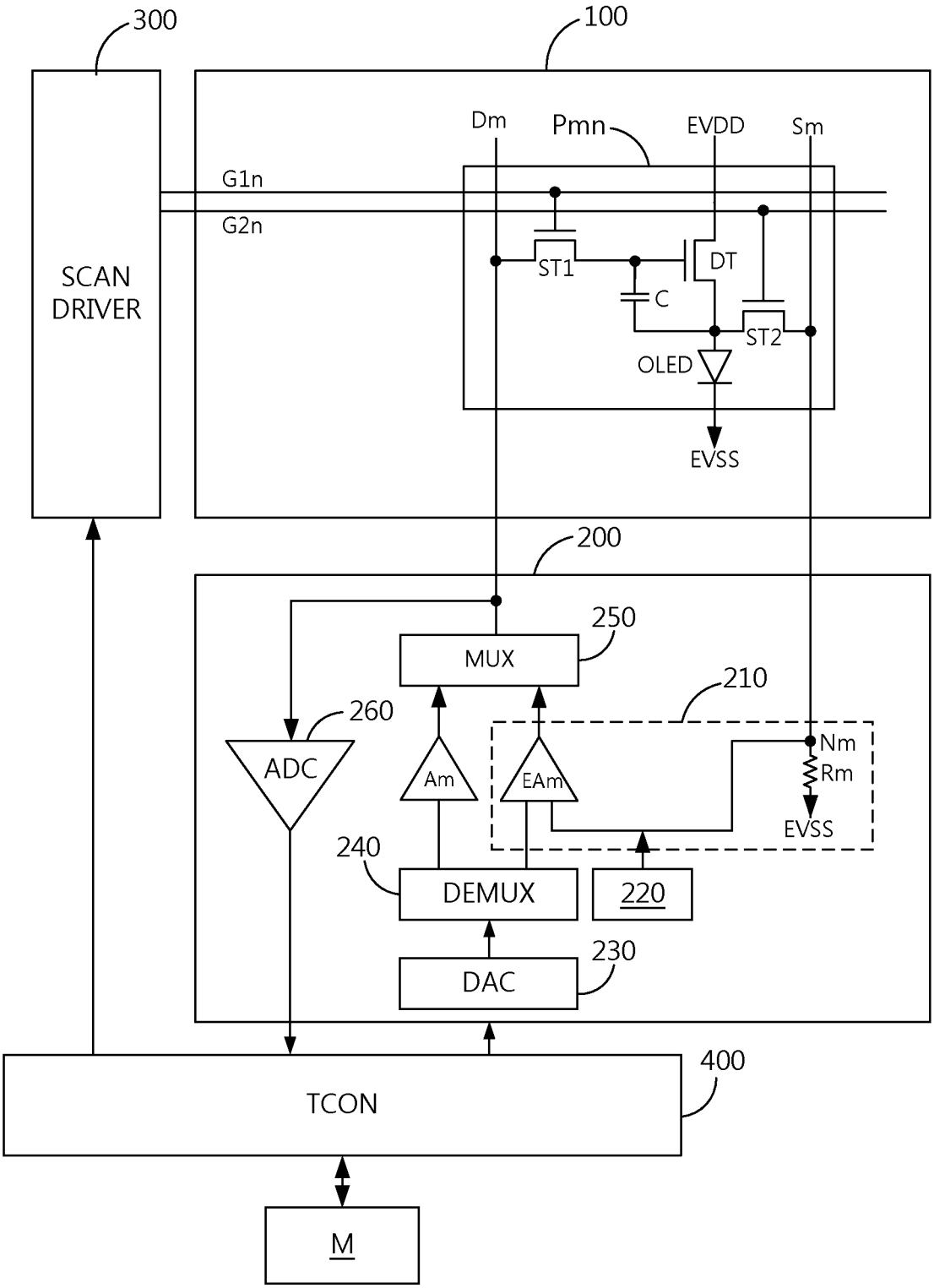
FIG. 10 is a circuit diagram illustrating a partial configuration of an OLED display device according to an embodiment of the present invention.
Figure 11:
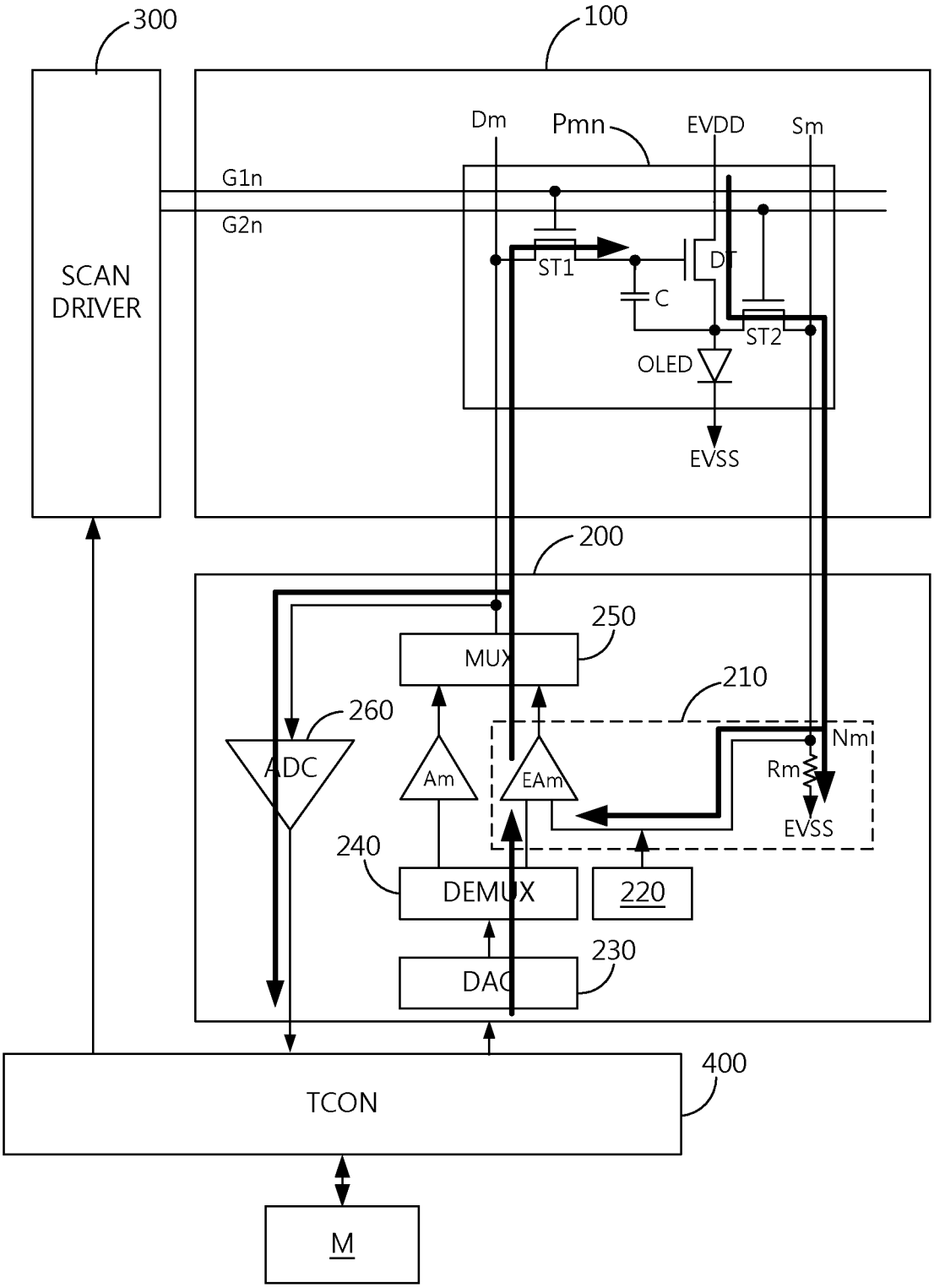
FIG. 11 is a diagram illustrating an operation principle of a scan period of a voltage feedback compensation scheme of the OLED display device shown in FIG. 10.
Figure 12:
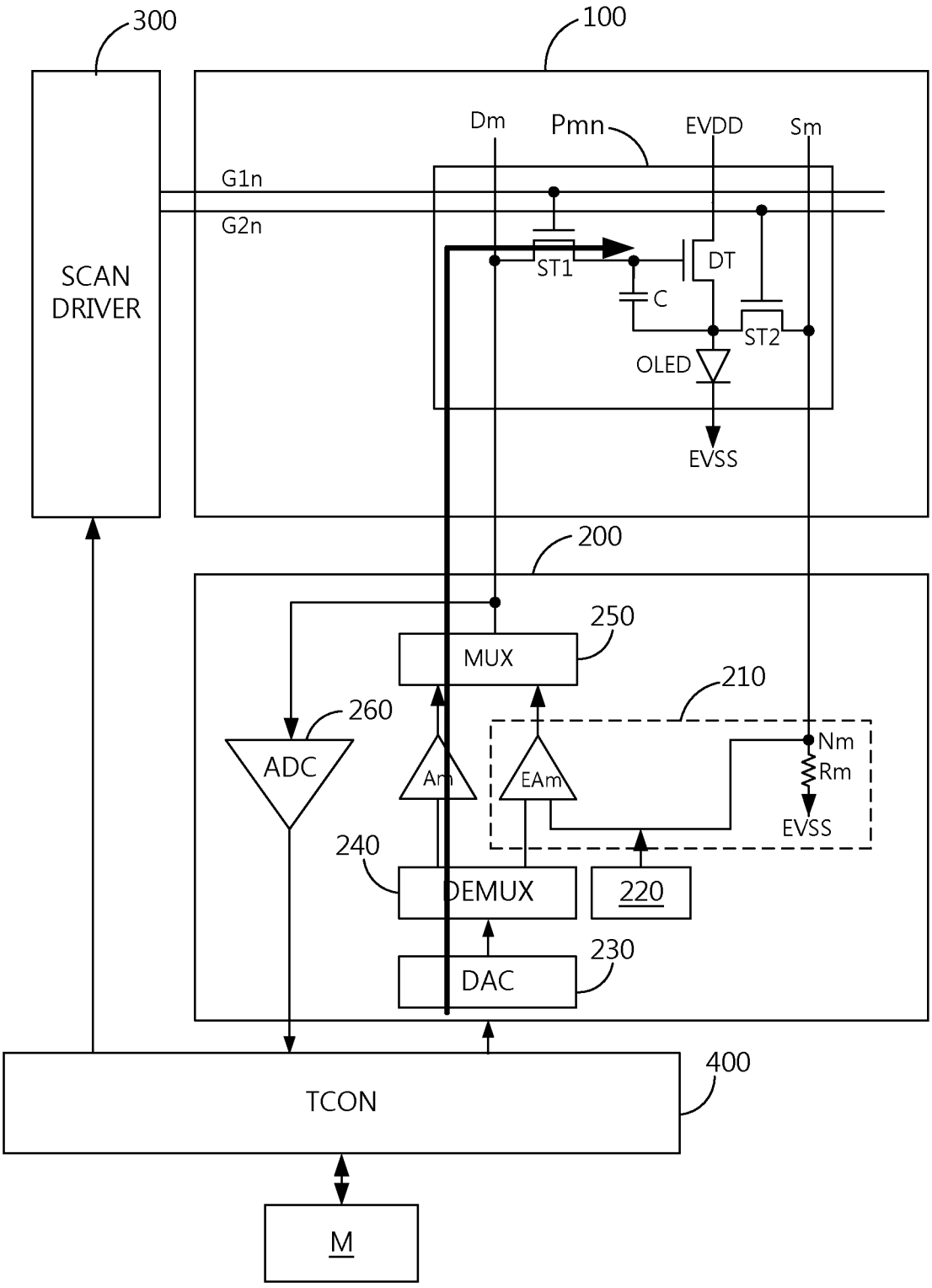
FIG. 12 is a diagram illustrating an operational principle of a normal scan period of the OLED display device shown in FIG. 10.

FIG. 10 is a circuit diagram illustrating a partial configuration of an OLED display device to which a scan period of a voltage feedback scheme is intermittently applied according to an embodiment of the present invention, FIG. 11 is a diagram illustrating an operation principle of a scan period of a voltage feedback compensation scheme, and FIG. 12 is a diagram illustrating an operational principle of a normal scan period.

Referring to FIGS. 10 to 12, the OLED display device according to an embodiment includes a TCON 400, a data driver 200, a scan driver 300, and a display panel 100.

The display panel 100 displays an image through a pixel array having pixels arranged in the form of a matrix. A basic pixel of the pixel array may be configured by at least three subpixels W/R/G, B/W/R, G/B/W, R/G/B, or W/R/G/B which can express white through color mixture of white (W), red (R), green (G), and blue (B) subpixels. Each pixel Pmn includes, as described in the above embodiments, the OLED element, and the pixel circuit including the driving TFT DT for independently driving the OLED element, the first and second switching TFTs ST1 and ST2, and the capacitor C.

The TCON 400 performs image processing, such as degradation compensation or reduction of dissipated power, on input image data and outputs the image processed data to the data driver 200. The TCON 400 generates a data control signal for controlling a driving timing of the data driver 200 and a gate control signal for controlling a driving timing of the scan driver 300, using input timing control signals, and outputs the data control signal and the gate control signal to the data driver 200 and the scan driver 300, respectively.

In particular, the TCON 400 controls the driving timings such that the data driver 200 and the scan driver 300 are driven during the scan period of the voltage feedback compensation scheme and the normal scan duration described with reference to FIGS. 8 and 9. The TCON 400 may control the scan period of the voltage feedback compensation scheme to be longer than the normal scan period, using the control signals for controlling the data driver 200 and scan driver 300. For example, the TCON 400 may configure different scan periods by adjusting a pulse width of a clock signal which determines each scan period.

In addition, during the scan period of the voltage feedback compensation scheme, the TCON 400 senses a data output voltage Vdata_o which is set through feedback compensation by the data driver 200 and is output to a data line Dm and calculates characteristic information (threshold voltage and mobility) of each pixel, e.g., each driving TFT DT, by comparing the sensed data output voltage Vdata_o with a data input voltage Vdata_i. In addition, the TCON 400 determines a compensation value (offset or gain) of each pixel by a known method using the characteristic information of each pixel and stores the compensation value in a memory M.

Additionally, during the normal scan period, the TCON 400 reads out the compensation value of each pixel stored in the memory M and compensates for image data to be supplied to each pixel to output the compensated image data to the data driver 200.

The scan driver 300 drives a plurality of gate lines G1*n* and G2*n* of the display panel 100 using the gate control signal supplied from the TCON 400. The scan driver 300 supplies a scan pulse of a gate-ON voltage in response to the gate control signal during a scan period of each pixel row and supplies a gate-OFF voltage during the other periods.

The scan driver 300 supplies a scan pulse having a relatively wide width to the gate lines G1*n* and G2*n* as illustrated in FIGS. 8 and 9, according to control of the TCON 400 during the scan period of the voltage feedback compensation scheme and supplies a scan pulse having a relatively narrow width to the gate lines G1*n* and G2*n* during the normal scan period.

The data driver 200 receives the data control signal and the image data from the TCON 400. The data driver 200 is driven according to the data control signal, converts digital image data into an analog voltage using gamma voltages supplied from a gamma voltage generator, and generates the data input voltage Vdata_i.

The data driver 200 sets the data output voltage Vdata_o according to a result of comparison between the data input voltage Vdata_i and the feedback voltage Vfb through the feedback compensation scheme according to control of the TCON 400 during the scan period of the voltage feedback compensation scheme to output the set data output voltage to the data line Dm, senses the data output voltage Vdata_o output to the data line Dm, and converts the sensed voltage into digital sensing data to output the digital sensing data to the TCON 400.

The data driver 200 buffers the data input voltage Vdata_i according to control of the TCON 400 during the normal scan period and supplies the data output voltage Vdata_o to the data line Dm.

To this end, the data driver 200 includes a digital-to-analog converter (hereinafter, DAC) 230, a demultiplexer (hereinafter, DEMUX) 240, a feedback compensator circuit 210, an output buffer Am, a multiplexer (hereinafter, MUX) 250, and an analog-to-digital converter (hereinafter, ADC) 260.

The timing controller is configured to control the multiplexer to select a first data output voltage for providing to the data line during a first scan period in which the feedback compensation is applied and to select a second data output voltage for providing to the data line during other scan periods in which the feedback compensation is not applied. For example, for a given pixel, the timing controller controls the multiplexer to select the first data output voltage where the feedback compensation is applied every N scan periods, where N is a number of pixel rows in the display panel.

Referring to FIG. 11, during the scan period of the feedback compensation scheme, the DAC 230 of the data driver 200 converts the digital image data supplied from the TCON 400 into an analog data voltage and supplies, as the data input voltage Vdata_i, the analog data voltage to the error amplifier EAm of the feedback compensator circuit 210 through the DEMUX 240. As described in the foregoing embodiments, the feedback compensator circuit 210 sets a first data output voltage Vdata_o according to a result of comparison between the data input voltage Vdata_i and the feedback voltage Vfb. The MUX is configured to select the first data output voltage Vdata_o during the scan period in which the data compensation scheme is used and outputs the set data output voltage to the data line Dm. In this case, the ADC 260 senses the data output voltage Vdata_o output to the data line Dm by the data driver 200, converts the sensed voltage into digital sensing data, and outputs the digital sensing data to the TCON 400.

Referring to FIG. 12, during the normal scan period (in which the data compensation scheme is not applied), the DAC 230 of the data driver 200 converts the digital image data supplied from the TCON 400 into the analog data voltage and outputs, as the data output voltage Vdata_o, the analog data voltage to the data line Dm through the DEMUX 240, the output buffer Am, and the MUX 250. Here, the output buffer Am is configured to receive the data input voltage from the DEMUX 240 and buffer the data input voltage to generate a second data output voltage that is selected by the MUX 250.

An OLED display device according to an embodiment compensates for a data output voltage supplied to each pixel on a real-time basis by comparing a data input voltage with a voltage which is fed back according to a driving current of the pixel to set a target current matching the data input voltage regardless of the driving deviation of each pixel, thereby causing each pixel to emit light. In addition, since the OLED display device can reduce the charging time of a feedback line through precharging of the feedback line or the output terminal of an error amplifier, the configuration of an external compensation circuit can be simplified and a scan period of a voltage feedback compensation scheme can be reduced.

In this way, the OLED display device according to an embodiment intermittently applies the scan period of the feedback compensation scheme in each frame so that a scan time of all lines can be further reduced relative to the case in which the feedback compensation scheme is applied to all scan lines. Therefore, the OLED display device according to an embodiment can be advantageously applied to a high-resolution display device.

It will be apparent to those skilled in the art that various modifications and variations can be made in the present invention without departing from the spirit or scope of the invention. Thus, the present invention is intended to cover the modifications and variations of this invention within the scope of the appended claims and their equivalents.

What is claimed is:

1. An organic light-emitting diode (OLED) display device, comprising:

a display panel including a pixel;

a feedback compensator circuit connected to the pixel through a data line and a sensing line of the display panel, the feedback compensator circuit including:

a sensing resistor configured to generate a feedback voltage on a feedback line based on a feedback current flowing through the sensing line during a scan period; and an error amplifier configured to receive the feedback voltage at an inverting input terminal from the feedback line and a data input voltage at a non-inverting input terminal from an input line, to compare the data input voltage with the feedback voltage to generate a data output voltage based on a difference between the data input voltage and the feedback voltage, and to supply the data output voltage to the pixel through the data line, wherein the data output voltage sets a target current for driving an OLED element in the pixel; and a precharger circuit configured to cause the data line to precharge during a precharge period at an initial portion of the scan period, wherein the precharger circuit includes a precharge switch to connect the inverting input terminal of the error amplifier or an output terminal of the error amplifier to a precharge voltage during the precharge period, wherein the precharge voltage comprises the data input voltage or a power supply voltage from a power source; wherein, during both the precharge period when the precharge switch is on and a period of the scan period when the precharge switch is off, the output terminal of the error amplifier supplies the data output voltage to the data line.

2. The OLED display device according to claim 1, wherein the pixel includes:

a driving thin film transistor (TFT) configured to drive the OLED element;

a first switching TFT controlled by a first gate line and configured to connect the data line to a gate electrode of the driving TFT during the scan period;

a second switching TFT controlled by a second gate line and configured to connect the sensing line to a source electrode of the driving TFT during the scan period; and a capacitor connected between the gate electrode and the source electrode of the driving TFT and configured to store a driving voltage of the driving TFT determined by the target current set during the scan period and maintain the driving voltage during a light-emitting period following the scan period.

3. The OLED display device according to claim 1, wherein the precharger circuit includes:

the precharge switch connected between the non-inverting input terminal of the error amplifier and the inverting input terminal of the error amplifier, the non-inverting input terminal being connected to the input line for supplying the data input voltage and the inverting input terminal being connected to the feedback line; and an amplifier configured to compare the data input voltage with the feedback voltage to control the precharge switch to turn on when the data input voltage has greater than a threshold difference from the feedback voltage, and wherein the precharger circuit precharges the feedback line to the data input voltage as the precharge voltage during the precharge period when the precharge switch is on.

4. The OLED display device according to claim 1, wherein the precharger circuit includes the precharge switch configured to couple the feedback line to the power supply voltage supplied from the power source in response to a precharge control signal during the precharge period, and wherein the precharge voltage is based on a degradation estimation value calculated by accumulating image data displayed on the display panel.

5. The OLED display device according to claim 1, wherein the precharger circuit includes the precharge switch configured to couple the feedback line to the data input voltage in response to a precharge control signal during the precharge period to precharge the feedback line to the data input voltage.

6. The OLED display device according to claim 1, further comprising:

a scan driver configured to drive a gate line of the display panel;

a data driver including the feedback compensator circuit and an output buffer; and a timing controller configured to control driving timings of the scan driver and the data driver, the timing controller to control timing of a first scan period during which the feedback compensator circuit generates the data output voltage and a second scan period during which the output buffer generates the data output voltage by buffering the data input voltage, the second scan period shorter than the first scan period.

7. The OLED display device according to claim 6, wherein the timing controller controls the scan driver and the data driver such that pixels within a same row as the pixel use respective feedback compensation circuits to generate respective data output voltages during the first scan period of the pixel, and wherein pixels outside the same row as the pixel use respective output buffers to generate respective data output voltages during the first scan period of the pixel.

8. The OLED display device according to claim 6, wherein, during the first scan period, the data driver converts image data supplied from the timing controller into the data input voltage and outputs the data output voltage controlled by the feedback compensator circuit to the data line, senses the data output voltage output to the data line, converts the sensed data output voltage into digital data, and supplies the digital data to the timing controller as sensing data, and wherein the timing controller compares the image data supplied to the data driver with the sensing data sensed by the data driver to determine a difference, calculates a compensation value for compensating for a characteristic deviation of the pixel based on the difference, and stores the calculated compensation value in a memory.

9. The OLED display device according to claim 8, wherein, during the second scan period, the data driver converts the image data supplied from the timing controller into the data input voltage, buffers the data input voltage through the output buffer, and outputs the buffered data input voltage as the data output voltage, and wherein the timing controller adjusts input image data using the compensation value stored in the memory and outputs the compensated image data to the data driver.

10. An organic light-emitting diode (OLED) display device, comprising:

a display panel including a pixel;

a data driver configured to drive a data line of the pixel and to receive a feedback voltage from a feedback line of the pixel, the data driver including:

an error amplifier configured to receive a feedback voltage from the feedback line and a data input voltage from an input line and to compare the data input voltage with the feedback voltage to generate a first data output voltage based on a difference between the data input voltage and the feedback voltage;

an output buffer configured to receive the data input voltage and to buffer the data input voltage to generate a second data output voltage; and a multiplexer configured to select between providing the first data output voltage and the second data output voltage to a data line of a corresponding pixel; and a timing controller configured to control the multiplexer to select the first data output voltage for providing to the data line during a first scan period and to select the second data output voltage for providing to the data line during a second scan period.

11. The OLED display device of claim 10, wherein the timing controller selects the first data output voltage during every N scan periods of the pixel and the timing controller selects the second data output voltage during remaining scan periods of the pixel, where N is a number of pixel rows in the display panel.

12. The OLED display device of claim 10, further comprising:

a sensing resistor to generate the feedback voltage on a feedback line based on a feedback current flowing through the sensing line during the first scan period; and a precharger circuit configured to cause the data line to precharge during a precharge period at an initial portion of the first scan period.

13. The OLED display device according to claim 12, wherein the precharger circuit includes:

a precharge switch connected between a first input terminal of the error amplifier and a second input terminal of the error amplifier, the first input terminal being connected to the input line for supplying the data input voltage and the second input terminal being connected to the feedback line; and an amplifier configured to compare the data input voltage with the feedback voltage to control the precharge switch to turn on when the data input voltage has greater than a threshold difference from the feedback voltage, and wherein the precharger circuit precharges the feedback line to the data input voltage during the precharge period when the precharge switch is on.

14. The OLED device according to claim 12, wherein the precharger circuit includes a precharge switch configured to couple the feedback line to a precharge voltage supplied from a power source in response to a precharge control signal during the precharge period, and wherein the precharge voltage is based on a degradation estimation value calculated by accumulating image data displayed on the display panel.

15. A method for operating an organic light-emitting diode (OLED) display device having a display device including a pixel, the method comprising:

generating, by a sensing resistor, a feedback voltage on a feedback line based on a feedback current flowing through a sensing line of the pixel during a scan period;

comparing, by an error amplifier, a data input voltage received at a non-inverting input terminal of the error amplifier with the feedback voltage received at an inverting input terminal of the error amplifier to generate a data output voltage based on a difference between the data input voltage and the feedback voltage;

supplying, by the error amplifier output terminal, the data output voltage to a data line of the pixel, wherein the data output voltage sets a target current for driving an OLED element in the pixel; and causing, by a precharger circuit, the data line to precharge during a precharge period at an initial portion of the scan period, wherein a precharge switch of the precharger circuit couples the inverting input terminal of the error amplifier to a precharge voltage during the precharge period, wherein the precharge voltage comprises the data input voltage or a power supply voltage from a power source, wherein, during both the precharge period when the precharge switch is on and a period of the scan period when the precharge switch is off, the error amplifier output terminal supplies the data output voltage to the data line.

16. The method of claim 15, wherein causing the data line to precharge comprises:

comparing by an amplifier, the data input voltage with the feedback voltage; and controlling the precharge switch to turn on when the data input voltage has greater than a threshold difference from the feedback voltage, the precharge switch connected between the non-inverting input terminal of the error amplifier and the inverting input terminal of the error amplifier, the non-inverting input terminal being connected to the data input line for supplying the data input voltage and the inverting input fccdback terminal being connected to the feedback line.

17. The method of claim 15, wherein causing the data line to precharge comprises:

obtaining, from the power source, the precharge voltage based on a degradation estimation value calculated by accumulating image data displayed on the display panel; and controlling the precharge switch to couple the feedback line to the precharge voltage supplied from the power source in response to a precharge control signal received from a timing controller.

18. The method of claim 15, wherein causing the data line to precharge comprises:

controlling the precharge switch to couple the feedback line to the data input voltage in response to a precharge control signal received from a timing controller.

19. An organic light-emitting diode (OLED) display device, comprising: a display panel including a pixel;

a feedback compensator circuit connected to the pixel through a data line and a sensing line of the display panel, the feedback compensator circuit including:

a sensing resistor configured to generate a feedback voltage on a feedback line based on a feedback current flowing through the sensing line during a scan period; and an error amplifier configured to receive at an inverting input terminal, the feedback voltage from the feedback line, and at a non-inverting input terminal, a data input voltage from an input line, to compare the data input voltage with the feedback voltage to generate a data output voltage based on a difference between the data input voltage and the feedback voltage, and to supply the data output voltage to the pixel through the data line, wherein the data output voltage sets a target current for driving an OLED element in the pixel; and a precharger circuit configured to cause the data line to precharge during a precharge period at an initial portion of the scan period, wherein the precharger circuit includes a precharge switch to couple an output terminal of the error amplifier providing the data output voltage to a precharge voltage during the precharge period, wherein the precharge voltage is based on a degradation estimation value calculated by accumulating image data displayed on the display panel; wherein, during both the precharge period when the precharge switch is on and a period of the scan period when the precharge switch is off, the output terminal of the error amplifier supplies the data output voltage to the data line.

* * * * *